US009109379B1

(12) United States Patent
Ranchod

(10) Patent No.: US 9,109,379 B1
(45) Date of Patent: Aug. 18, 2015

(54) KEYLESS PADLOCK, SYSTEM AND METHOD OF USE

(71) Applicant: Dog & Bone Holdings Pty Ltd, Red Hill (AU)

(72) Inventor: Lee Brett Ranchod, Willawong (AU)

(73) Assignee: Dog & Bone Holdings Pty Ltd, Queensland (AU)

( * ) Notice: Subject to any disclaimer, the term of this patent is extended or adjusted under 35 U.S.C. 154(b) by 0 days.

(21) Appl. No.: 14/457,333

(22) Filed: Aug. 12, 2014

(51) Int. Cl.
*E05B 67/24* (2006.01)
*E05B 67/00* (2006.01)
*E05B 47/00* (2006.01)

(52) U.S. Cl.
CPC ..... *E05B 67/00* (2013.01); *E05B 47/00* (2013.01)

(58) Field of Classification Search
CPC ... E05B 73/0082; E05B 73/00; E05B 39/005; E05B 45/005; E05B 47/0001; E05B 47/0012; E05B 67/383; E05B 71/00; G06F 21/86; G06F 21/88; H04M 2250/10; H04W 4/22; B62H 5/20
USPC ..... 70/20, 38 A–38 C, 38, 39, 257, 277, 70/278.1, 278.7, 386; 340/5.53, 5.7
See application file for complete search history.

(56) References Cited

U.S. PATENT DOCUMENTS

| | | | | |
|---|---|---|---|---|
| 6,047,575 | A * | 4/2000 | Larson et al. | 70/278.1 |
| 6,442,983 | B1 * | 9/2002 | Thomas et al. | 70/38 A |
| 7,236,085 | B1 * | 6/2007 | Aronson et al. | 340/5.64 |
| 7,382,250 | B2 * | 6/2008 | Marcelle et al. | 340/542 |
| 8,353,187 | B2 * | 1/2013 | Woodling | 70/278.7 |
| 8,453,481 | B2 * | 6/2013 | Meekma | 70/38 A |
| 2005/0231365 | A1 * | 10/2005 | Tester et al. | 340/568.1 |
| 2006/0283216 | A1 * | 12/2006 | Marcelle et al. | 70/38 A |
| 2006/0288744 | A1 * | 12/2006 | Smith | 70/38 B |
| 2007/0126551 | A1 * | 6/2007 | Slevin | 340/5.53 |
| 2009/0271295 | A1 * | 10/2009 | Hodge | 705/27 |
| 2009/0282876 | A1 * | 11/2009 | Zuraski et al. | 70/35 |
| 2011/0273852 | A1 * | 11/2011 | Debrody et al. | 361/747 |
| 2013/0086956 | A1 * | 4/2013 | Nave | 70/20 |
| 2013/0118216 | A1 * | 5/2013 | Kalous et al. | 70/24 |
| 2013/0183924 | A1 * | 7/2013 | Saigh et al. | 455/404.2 |
| 2014/0002239 | A1 * | 1/2014 | Rayner | 340/5.61 |
| 2014/0109631 | A1 * | 4/2014 | Asquith et al. | 70/15 |
| 2014/0150502 | A1 * | 6/2014 | Duncan | 70/20 |
| 2014/0250954 | A1 * | 9/2014 | Buzhardt | 70/20 |

* cited by examiner

*Primary Examiner* — Suzanne Barrett
(74) *Attorney, Agent, or Firm* — The Webb Law Firm

(57) ABSTRACT

A keyless padlock having a padlock body, a shackle, a locking mechanism located in the body and associated with the shackle to lock the shackle to the body in a locked condition and to release at least a part of the shackle in an unlocked condition, the locking mechanism including a signal receiver, at least one control assembly and at least one actuator, the locking mechanism being unlocked upon verification of a signal including an unlock code transmitted by a mobile computing device.

16 Claims, 7 Drawing Sheets

KEYLESS PADLOCK, SYSTEM AND METHOD OF USE

TECHNICAL FIELD

The present invention relates to padlocks, and in particular to padlocks that are operable using a signal from a personal computing device.

BACKGROUND ART

Padlocks are well known in the marketplace and are widely used to lock doors, gates and the like. Padlocks can be seen as are portable locks which can be removed from the door/gate or the like or other application when the lock is not required. This distinguishes padlocks from other forms of locks such as those that are retained in doors, windows, gates etc.

Typical padlocks are formed with a strong padlock body (typically generally of brass or steel), and the padlock body usually contains a main passageway opening. A key barrel cylinder (usually in the form of a key barrel) can be fitted in the main passageway opening so that a key can be used to open the padlock can be opened (again, usually by inserting and turning a key).

Padlocks also typically have a shackle. The shackle typically generally comprises a rigid U-shaped metal member which can be formed from steel or brass. The parallel portions of the U-shaped shackle form two spaced apart parallel legs and one leg is generally longer than the other. The In conventional padlocks, the longer leg passes through an opening in the top of the padlock body and is secured therein in such a manner that the leg cannot be pulled out. When the padlock is open, the secured long leg is often able to pivot about its axis so that the short leg (i.e. the other leg of the U-shaped shackle) rotates in an arc about the long leg. The longer leg of the shackle is also generally able to slide axially inwards and outwards within the opening in the body (although in conventional padlocks the shackle cannot slide all the way out of the body).

Typically, padlocks are locked by moving the shackle downwardly so that the short leg is inserted into a blind bore in the top of the padlock body. The short leg is then lockable therein to lock the padlock. The padlock can be unlocked by operating the key cylinder, and a spring is typically provided to bias the shackle to the open condition (i.e. where the short leg is retracted upwardly out of the body and can rotate about the long leg as described). A Where the cylinder is a key barrel, a key can be inserted into the key cylinder barrel and turned to thereby release the shackle allowing the shackle to move upwardly into the open condition under the bias of the spring.

It will be clearly understood that, if a prior art publication is referred to herein, this reference does not constitute an admission that the publication forms part of the common general knowledge in the art in Australia or in any other country.

SUMMARY OF INVENTION

The present invention is directed to a keyless padlock, system and method of use, which may at least partially overcome at least one of the abovementioned disadvantages or provide the consumer with a useful or commercial choice.

With the foregoing in view, the present invention in one form, resides broadly in a keyless padlock having a padlock body, a shackle, a locking mechanism located in the body and associated with the shackle to lock the shackle to the body in a locked condition and to release at least a part of the shackle in an unlocked condition, the locking mechanism including a signal receiver, at least one control assembly and at least one actuator, the locking mechanism being unlocked upon verification of a signal including an unlock code transmitted by a mobile computing device.

In another form, the invention resides in a system including a keyless padlock including a padlock body, a shackle, a locking mechanism located in the body and associated with the shackle to lock the shackle to the body in a locked condition and to release at least a part of the shackle in an unlocked condition, at least one receiver, at least one control assembly and at least one actuator and a personal computing device having at least one transmitter, a processor with memory operating a software application and a display, the software application accessing a identifying code unique to the keyless padlock and transmitting said identifying code to the padlock, wherein the at least one control assembly of the padlock will trigger the at least one actuator to unlock the padlock shackle if the identifying code received by the at least one receiver of the padlock matches that of the padlock and will not open if the identifying code does not match.

The system of the present invention includes a keyless padlock and a personal computing device. The personal computing device typically has at least one transmitter, a processor with memory and display. The processor and memory will typically store, and then action, instructions which are saved in the form of a software application or program. The keyless padlock of the preferred embodiment will typically include at least one receiver, at least one control assembly and at least one actuator to move the locking mechanism between the locked and unlocked condition upon receipt of the unique identifying code.

The software application operating on the personal computing device will typically access a unique identifying code which is particular to the keyless padlock and as desired, transmit that unique identifying code to be keyless padlock. Once the keyless padlock receives the unique identifying code via the receiver, the at least one control assembly will typically trigger the at least one actuator to lock or unlock the padlock is the unique identifying code received matches that required by the keyless padlock and the keyless padlock will not be locked or unlocked if the unique identifying code does not match.

The provision of a unique identifying code means that the keyless padlock does not require a physical key, nor preferably as the provision in the keyless padlock for insertion of a physical key in order to open the padlock.

The unique identifying code is typically a code or signal which is preferably matched to the keyless padlock. The unique identifying code and the keyless padlock may form a matched pair with the same code being provided to the keyless padlock each time the padlock is required to be operated or alternatively the unique identifying code may be generated substantially in real time as the operation of the keyless padlock is prompted. In this particular configuration, additional communication components will typically be required, both in the keyless padlock and in relation to the personal computing device in order to allow the unique identifying code to be generated, matched against a particular keyless padlock, provided to the owner or a third party so that the owner or third-party can access the keyless padlock.

The keyless padlock of the present invention may use multifactor authentication protocols. These protocols are typically well-known in the area of banking whereupon in order to access the account record, the person requesting access is required to have access to at least two, separate communications channels with identifying information requesting access being entered using one of the communications channels and a separate, authorisation code is generated and sent to the requestor via an independent communications channel (and typically to an independent device) with access being granted only if the generated authorisation code is then entered with the normal identifying information. A similar system may be used in relation to the keyless padlock of the present invention in order to increase security.

Typically, in multifactor authentication model of the present invention, an owner will have access to the unique identifying code of the padlock and can transmit this to the padlock, whereupon the padlock requests that an authorisation code be generated and sent to the owner's registered personal computing device which can then be transmitted to the padlock. The authorisation code will also typically be forwarded to the padlock by the generation apparatus and the padlock is operable if the authorisation code received by the padlock from the generation apparatus matches that transmitted by the personal computing device. It is noted at this juncture that the user operating or requesting operation of the padlock may not be the owner of the padlock as in certain circumstances, the owner of the padlock may authorise a third party to activate the padlock. However in this situation, the owner will have two provide the unique identifying code of the padlock and any other authorisation code which may be required according to the protocol of operation of the padlock.

Typically, the padlock will include at least a receiver in order to receive the unique identifying code. As mentioned above, in certain circumstances, the padlock may include a transmitter in order to request additional information either from the user, from a third-party or from an external system administrator. The inclusion of a transmitter have may be less desirable as it may increase the size of the padlock and therefore, the receiver-only version may be preferred. The transmitter version, implementing a multifactor authentication protocol, would typically make the lock more secure but may result in a more bulky padlock.

The provision of the unique identifying code to the padlock may be undertaken by any personal computing device or alternatively, a specific personal computer device may be required to send the unique identifying code. Therefore, according to a preferred embodiment, the unique identifying code may include one or more details which are unique to the personal computer device transmitting the code or the transmission may include both unique identifying code and one or more details which are unique to the personal computing device transmitting the code. The one or more details unique to the personal computing device may be obtained directly from the personal computing device each time the transmission is made rather than being stored in the software application as this would typically be a more secure method, but storage of details relating to the personal computing device within the software application, is an option.

In normal circumstances, and according to the simplest embodiment, the keyless padlock of the present invention will be sold in a package with access provided to the software application, typically by download to the purchaser's personal computing device. Once the software application has been downloaded, the personal computing device or software application can then be "paired" with the keyless padlock. In this particular initialisation pairing, the personal computing device will typically be provided with information in relation to the unique identifying code of the keyless padlock. In the simplest embodiment, this unique identifying code will therefore be an alphanumeric code (or any other suitable type of code) provided with the keyless padlock and which is entered into the software application operating on the personal computing device. The software application will typically include a subroutine allowing this to occur when initially pairing the keyless padlock with the application running on the personal computer device.

Once the keyless padlock has been paired with the software application operating on the personal computing device, then the personal computer device can then be used to transmit this code to the keyless padlock as desired by the user in order to operate the padlock. The at least one control assembly of the keyless padlock will typically compare the received code to the unique identifying code of the padlock and operate the padlock or not depending upon whether the code matches or not.

As mentioned above, the unique identifying code may be provided by third party on behalf of the authorised user in order to allow the third-party to operate the keyless padlock. In this circumstance, typically the unique identifying code will be provided to the third-party by the authorised user or with the authorised user's consent from a system administrator or similar. Typically, the authorised user will either provide the unique identifying code directly to the third-party or authorise the provision of the unique identifying code to the third-party. Normally this will be done through the software application. In particular, the authorised user will typically be able to add authorised third parties into their own personal computing device which then allows the authorised user to transmit a message to third parties as and when the authorised user wishes to authorise them to operate the keyless padlock whereupon the software application will transmit an information package or signal to the personal computer device of the third-party when authorised, which the third-party can then use to provide the unique identifying code to the keyless padlock. Importantly, this system may operate such that the third-party does not ever have knowledge of the particular unique identifying code but the unique identifying code is simply provided from the authorised users personal computing device to the third-party's personal computing device and once transmitted to the keyless padlock, is preferably erased or deleted from the third parties personal computer device or otherwise rendered inactive. The unique identifying code can in this instance be a single use code.

The system of the present invention preferably includes two component parts, namely the keyless padlock and software application which is operable on a personal computing device. The personal computing device can be of any type such as a tablet or computer or the like but will preferably be a smart phone or other similar device which is carried by a person and is therefore easily accessible to them at the majority of times. The personal computing device of the preferred embodiment will include a processor having an associated memory for storing instructions and a display upon which the interface can be generated and displayed allowing user interaction with the software application. As mentioned above, the personal computing device will typically include a transmitter for transmitting the unique identifying code and normally, personal computers and devices such as those discussed above have access to a number of communications pathways such that the unique identifying code can be transmitted via any one or more of a variety of communications pathways. These communications pathways typically include Wi-Fi, Bluetooth as well as telecommunications networks and data links or RFID but any portion of the electromagnetic spectrum could be used. According to the most preferred embodiment, the keyless padlock of the present invention will operate via Bluetooth.

Normally the software application operates according to instructions stored in the memory of the personal computing device and put into effect using the processor and controlled by interaction with the user via the interface generated and displayed on the display and/or other input apparatus provided with the personal computer device in order to retrieve and transmit the unique identifying code to the padlock as required. As mentioned above briefly, the unique identifying code may be stored on the personal computing device or alternatively, may be retrieved from a remote personal computing device or database. Whilst there are advantages and disadvantages to each of these methodologies, the simplest form the invention may store the unique identifying code of the particular keyless padlock in the memory of the personal computing device which has been paired with the keyless padlock.

The preferred embodiment of the software application is preferably relatively simple. The first time the software application is initialised (or alternatively at any time there after), the software application may engage one or more of the communications pathways of devices of the personal computing device upon which it is operating to search for devices which can be paired with the personal computing device. This will typically identify the keyless padlock as a device which can be paired. Pairing the keyless padlock with the personal computing device will typically allow the unique identifying code for the keyless padlock to be stored in the memory of the personal computer device. The pairing process may also provide information in relation to the user end/or the personal computing device of the user to be keyless padlock. Thereafter, as required, the authorised user will typically use the paired personal computer device to send unique identifying code to the padlock in order to operate the padlock. If the unique identifying code is a match to that of the keyless padlock, then the padlock can be operated and if not, the padlock can be operated.

The software application will typically also provide an interface that allows the location of the keyless padlock which has been paired with the particular personal computing device to be determined geographically. The interface may provide other information including status of the padlock and it may provide this information in any form but preferably, does so graphically. Because of the complexity of the personal computing devices which would typically be used according to the present invention, many of these will have access to positioning systems such as GPS. Typically, the software application, upon the padlock being locked, will typically note the position of the personal computing device (which will typically be relatively close to the keyless padlock) using the positioning system of the personal computing device installed this in the memory of the personal computing device. Alternatively, a user may prompt memory of the location using an action button or similar. This will allow a user to locate the keyless padlock which has been paired to the personal computing device if the user forgets where the padlock is located. This information can be forwarded to a third party if the authorised user requests that a third-party operate the lock. Typically, this information will be capable of display on the interface of the third party's personal computer device. Additional functionality may be provided within the software application allowing a user (whether an authorised user or a third party) to navigate to the lock using the information in conjunction with access to a positioning system such as GPS. Feedback may be given to the user via the personal computer device in order to locate the keyless padlock.

The software application can also preferably be used to authorise third parties to operate the keyless padlock. This authorisation may be provided to a third party by an authorised user permanently until revoked or alternatively, as outlined above, authorisation may be given on a single use basis.

Where an authorised user wishes to authorise third parties to operate the keyless padlock, the software application operating on the personal computing device will typically transmit or cause to be transmitted, the unique identifying code to the third party. Once the authorised third-party has operated the keyless padlock, the software application operating on the third party's personal computer device will typically provide feedback to the authorised user's personal computing device allowing the authorised user to ascertain the identity of the third-party operate keyless padlock in confirmation.

The second of the component parts is preferably the keyless padlock. The keyless padlock will typically include a body and a shackle which is lockable relative to the body. The body will typically include a locking mechanism in order to lock the shackle, and an actuator in order to move the locking mechanism to lock and unlock the shackle and a signal receiver in order to receive the unique identifying code. According to the most preferred embodiment, the keyless padlock of the present invention is typically similar to a conventional padlock but without the key cylinder used to operate a conventional padlock. In this embodiment, the body of the keyless padlock will include a battery or other similar power source in order to power the actuator, a camming member actuator in order to move the locking mechanism, and at least one control assembly such as a printed circuit board control to control operation of the actuator according to the signal received. The camming member actuator will typically move a camming member within the body between the locked and unlocked conditions.

The body of the keyless padlock of the preferred embodiment will typically be manufactured predominantly a metal but one or more sleeves, insert portions or covers can be provided of other materials in order to render the body of the keyless padlock more aesthetically or functionally pleasing. The body will typically include a pair of openings allowing the shackle to be open and closed relative to the body but to retain the long arm of the shackle attached to the body. As mentioned above, the body of the keyless padlock of the present invention will typically lack a key cylinder entirely. Instead, the body of the keyless padlock of the present invention will typically include a camming member actuator in order to move the camming member of the padlock between the locked and unlocked conditions in response to the transmission of the unique identifying code from the software application operating on the personal computing device. The battery, control assembly, actuator, locking mechanism and other associated devices allowing communication and interaction with the keyless padlock such as a USB port are all preferably provided in the body of the keyless padlock.

The shackle of the keyless padlock of the preferred embodiment is typically a conventional shackle.

The actuator provided in the body of the keyless padlock will typically be energised as required by the battery or other power source provided in the body (or energised by an external power source if desired) and controlled by the at least one control assembly. The actuator is typically approximately centrally located within the body of the keyless padlock in a position similar to that held by the key cylinder in a conventional padlock. Typically, the simplest embodiment of the control assembly will be a printed circuit board.

A switch may be provided in the body and particularly associated with a short arm of the shackle such that when the short arm the shackle is aligned with the respective opening in the body and depressed by the user in order to lock the padlock, the switch is typically activated which in turn is used to signal the actuator to rotate the camming member to lock the shackle.

According to the particularly preferred operation, in order to operate the lock, the user will open software application on the personal computing device and then choose the action button which transmits the unique identifying code of the keyless padlock to the keyless padlock (provided that the padlock and the personal computing device operating the software application have been paired). In this situation, only a single transmission is required and once received by the keyless padlock, provided the unique identifying code received matches that of the keyless padlock, the keyless padlock will be operable and will either lock or unlock depending upon its current state.

In the more inventive embodiment where multifactor authentication is required, transmission of the unique identifying code to the keyless padlock will result in the keyless padlock transmitting a signal to a remote system administrator which then generates a single use authentication code and transmits this code to be keyless padlock into the registered personal computing device of the authorised user. The authorised user can then use this single use authentication code to transmit to the keyless padlock and again, is the unique identifying code and the single use authentication codes match, the careless padlock will then be operable.

It can be seen that the keyless padlock system of the present invention provides distinctive advantages over the conventional padlock operation which requires a physical key and that the components and operation of the keyless padlock and the system of operation allows a user to use the padlock themselves securely or to authorise others to use the padlock on their behalf.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

According to a particularly preferred embodiment of the present invention, a keyless padlock system is provided.

Figure 1:
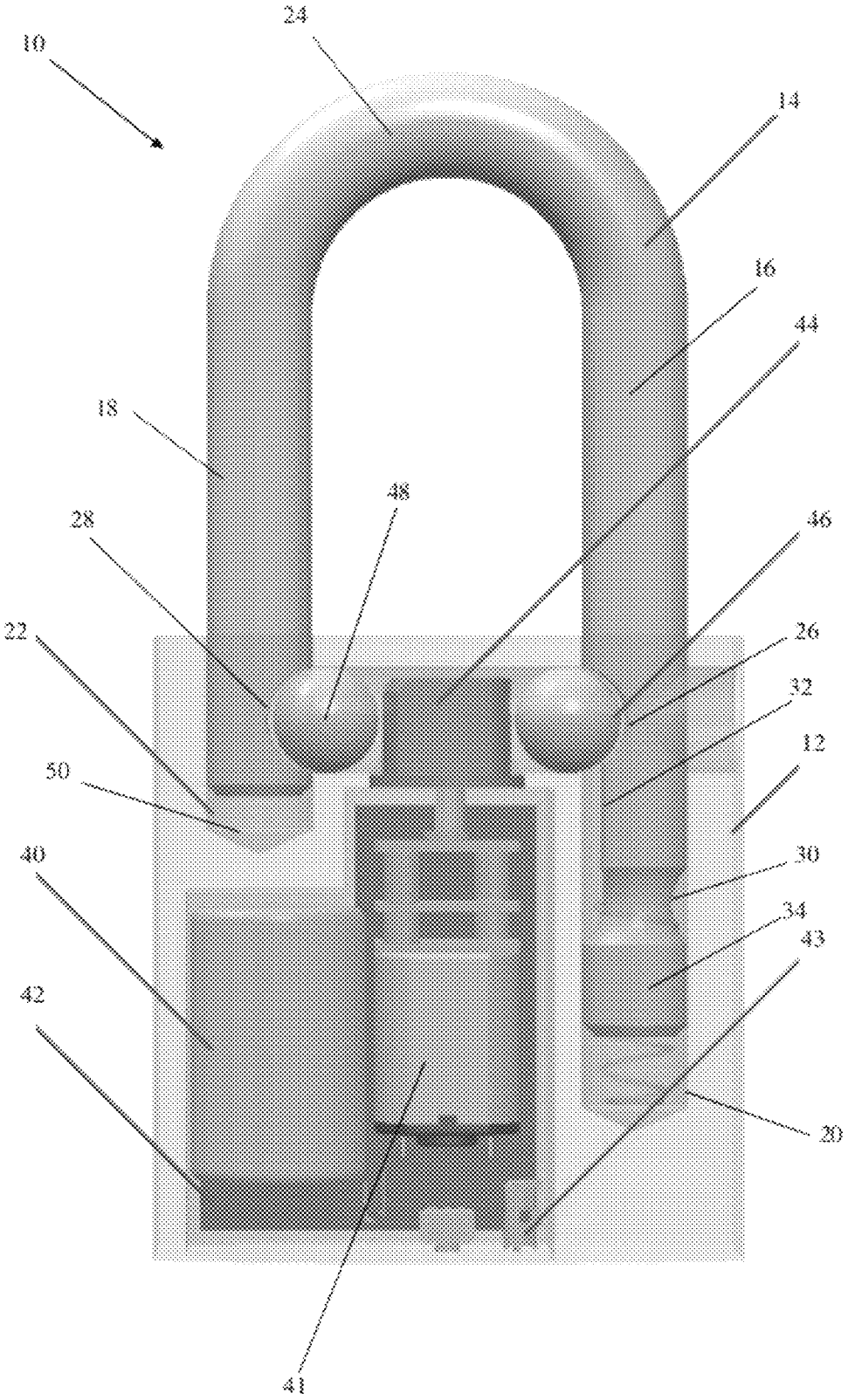
FIG. 1 is a schematic view of a keyless padlock according to a preferred embodiment of the present invention with the body transparent for clarity purposes.
Figure 2:
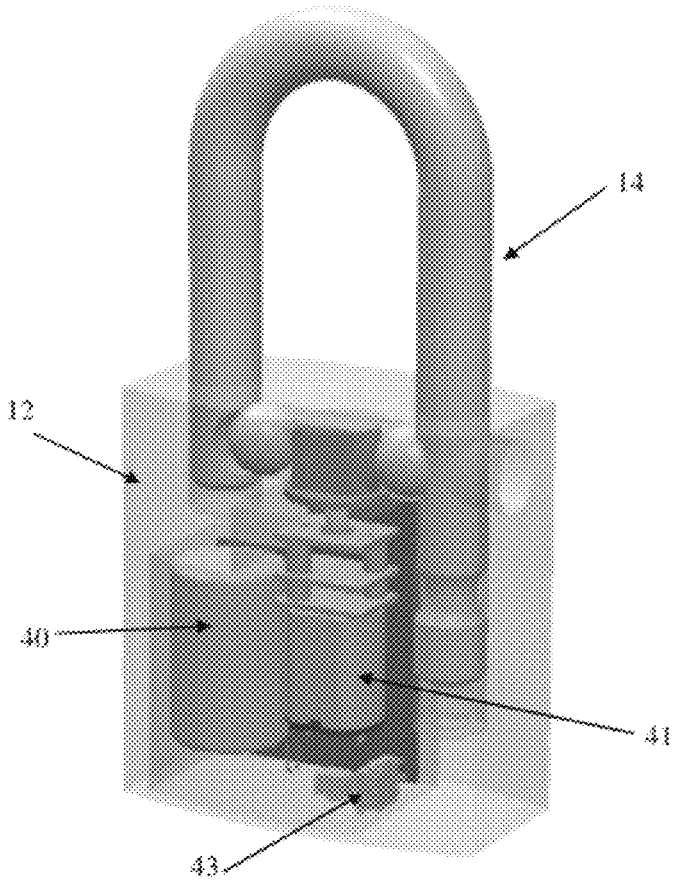
FIG. 2 is an axonometric view of the keyless padlock illustrated in FIG. 2.
Figure 3:
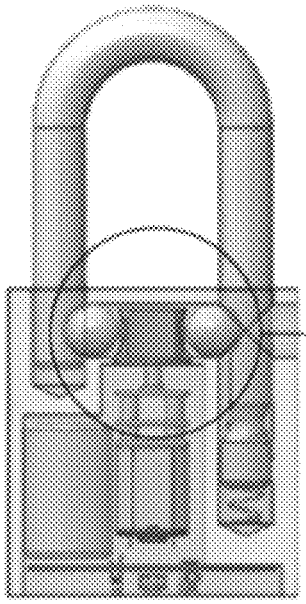
FIG. 3 is a schematic view front view of the keyless padlock illustrated in FIG. 1 in the locked condition.
Figure 3A:
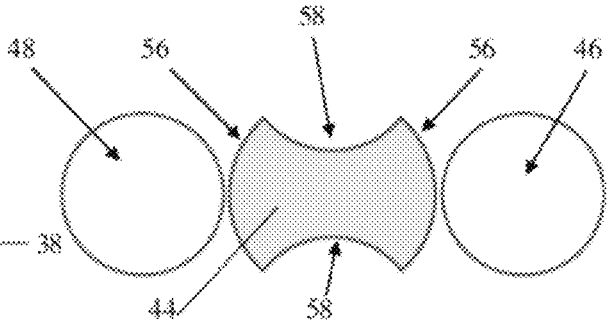
FIG. 3A is a schematic illustration from the top showing relative positions of the camming member and locking balls of the keyless padlock illustrated in FIG. 3.
Figure 4:
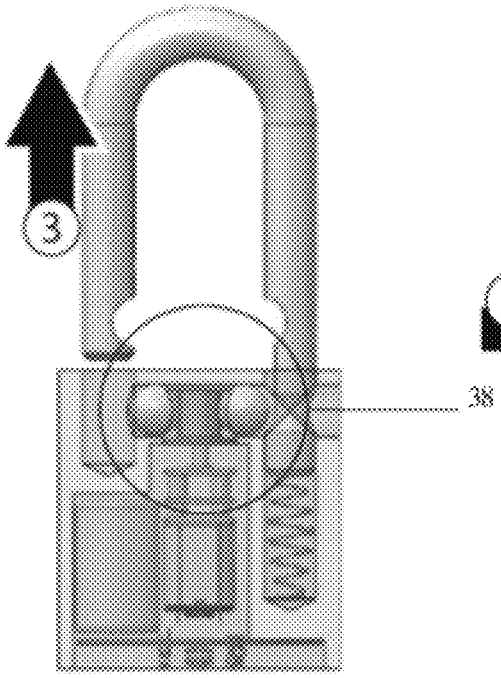
FIG. 4 is a schematic view front view of the keyless padlock illustrated in FIG. 1 in the unlocked condition.
Figure 4A:
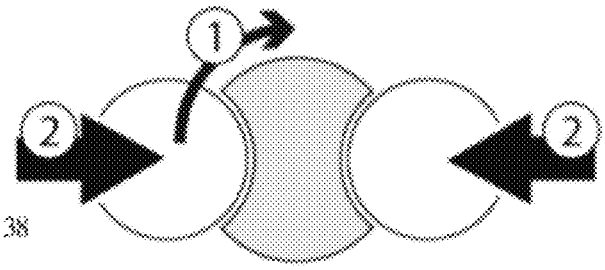
FIG. 4A is a schematic illustration from the top showing relative positions of the camming member and locking balls of the keyless padlock illustrated in FIG. 4.
Figure 5:
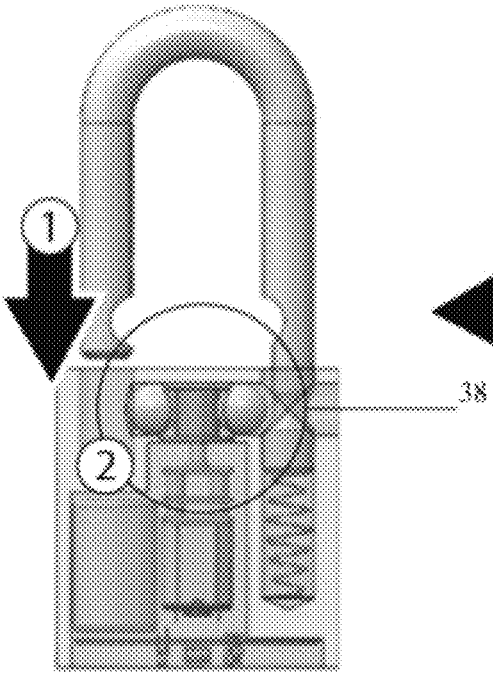
FIG. 5 is a schematic view front view of the keyless padlock illustrated in FIG. 1 showing the movement from the unlocked condition to the locked condition.
Figure 5A:
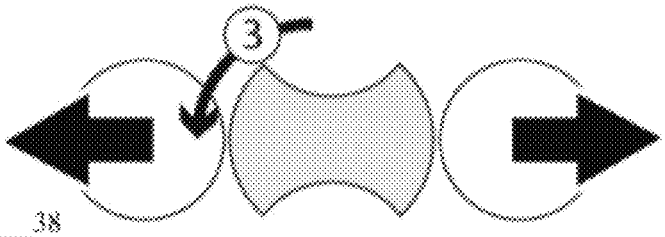
FIG. 5A is a schematic illustration from the top showing relative positions of the camming member and locking balls of the keyless padlock illustrated in FIG. 5.

With reference to FIG. 1, there is shown a keyless padlock 10 in accordance with a preferred embodiment of the present invention comprising a padlock body 12 and a shackle 14. Shackle 14 comprises a long leg 16 and short leg 18, and body 12 comprises a long leg bore 20 and a short leg bore 22. Long leg 16 is adapted to be insertable into long leg bore 20, and short leg 18 is adapted to be insertable into short leg bore 22.

Referring now to shackle 14 it can be seen that, in the orientation in FIG. 1, the general shape of shackle 14 is similar to that of an inverted "U". Therefore, the two parallel portions of the U form long leg 16 and short leg 18, and the upper end of the respective legs are integrally connected by an arcuate member 24 corresponding to the curved portion of the U. More specifically, in the embodiment shown, long leg 16 and short leg 18 are both substantially cylindrical (i.e. having a substantially circular cross-section) of equal diameter, and long leg 16 is substantially longer than short leg 18 so that the lower end of long leg 16 extends substantially below the lower end of short leg 18. Because the respective legs are substantially cylindrical, therefore arcuate member 24 (which is integrally formed with the legs) has a substantially semi-toroidal shape connecting the tops of the two legs and having approximately the same cross-section as the legs.

Both long leg 16 and short leg 18 have a locking notch 26, 28 therein. Notches 26, 28 comprise substantially semi-tubular cutouts in the inner side of the respective legs, the cutouts being oriented such that the longitudinal axis of each semi-tubular cutout is substantially perpendicular to the longitudinal axis of the respective legs and offset inwardly thereof. Notch 28 in short leg 18 is located towards the lower end of short leg 18, and notch 26 in long leg 16 is located approximately midway down the length of long leg 16 such that both the notches are located at substantially the same level, thus effectively making each notch a mirror image of the other.

Long leg 16 further comprises a groove 30, a retaining flat aperture in the form of inner flat 32, and a bottom surface 34. Groove 30, located towards the lower end of long leg 16, has a substantially semicircular cross-section and extends all the way around long leg 16. Thus, groove 30 forms a substantially circumferential cutout around the lower end of long leg 16. Importantly, the maximum depth to which groove 30 is recessed into long leg 16 is substantially less than the maximum depth to which notches 26, 28 are indented into the respective leg members.

Inner flat 32 comprises a substantially flat surface extending down the inner side of long leg 16 from the lower edge of notch 26 to groove 30. Inner flat 32 is also slightly indented into long leg 16 and it therefore forms a slightly recessed flat surface. The depth to which inner flat 32 is recessed into long leg 16 is approximately the same as the depth of groove 30. Therefore, inner flat 32 effectively blends smoothly into groove 30 at the point where the two intersect, and there is no distinct ridge, edge or other delineation between the two.

Referring again to FIG. 1, it can be seen that padlock assembly 10 has an internal locking mechanism 38 for locking and unlocking the padlock. Locking mechanism 38 comprises battery 40, at least one actuator 41, a printed circuit board 42, micro USB port 43, camming member 44, and locking balls 46, 48.

It can be seen that camming member 44 comprises a pair of convex camming surfaces 56 located on opposite sides thereof, and a pair of concave cavities 58 also located on opposed sides thereof and interposed between the camming surfaces 56. The locking balls 46, 48 are positioned one on either side of camming member 44. Camming member 44 is pivotable between a locked position and an unlocked position. FIG. 1 shows camming member 44 in the locked position wherein the camming surfaces 56 contact with the balls 46, 48, thereby pushing ball 46 into engagement with notch 26 in long leg 16 and pushing ball 48 into engagement with notch 28 in short leg 18. It will be clearly understood that the diameter of each of the balls 46, 48 is such that balls 46, 48 fit snugly and sufficiently deeply into notches 26 and 28 so as to prevent vertical movement of the respective legs within the body. Thus, when camming member 44 is in the locked position and both legs of the shackle are inserted into their respective bores in body 12, the legs are retained within body 12 by engagement of the balls 46, 48, and the padlock is locked.

Camming member 44 can be pivoted from the locked position into the unlocked position by rotating camming member 44 approximately 90° in the direction indicated by arrow "A" in FIG. 1 (counter clockwise when viewed from above). This is done by operating actuator 41, as explained in greater detail below.

When camming member 44 is pivoted into the unlocked position, locking balls 46, 48 are no longer in engagement with camming surfaces 56 and therefore they are not being pushed into engagement with the notches 26 and 28 in the legs. Instead, locking balls 46, 48 are allowed to retreat into the cavities 58 in camming member 44. It will be understood that cavities 58 are sufficiently deep, and that locking balls 46, 48 can retreat sufficiently far into cavities 58, such that the bottom edges of the respective notches 26 and 28 can move upwardly past balls 46, 48. Hence, rotation of camming member 44 into the unlocked position allows legs 16 and 18 of the shackle to move upwardly within the body 12. In particular, it allows short leg 18 to be retracted entirely out of short leg bore 22, thus opening the padlock.

However, it will also be understood that, even when balls 46, 48 are retracted into recesses 58, they are not retracted entirely within the cavities. Therefore, balls 46, 48 extend outwardly to some extent even when they are retracted into cavities 58, albeit to a lesser extent than they do when they are pushed into engagement with notches 26, 28 by camming surfaces 56. This is particularly important in relation to ball 46. It will be recalled that inner flat 32 (which is recessed slightly into long leg 16 but less deeply than notch 26) extends down the inside of long leg 16 between the lower edge of notch 26 and groove 30. Therefore, even though ball 46 retracts out of notch 26 when the balls are retracted into cavities 58, nevertheless ball 26 still extends outwardly sufficiently to engage with inner flat 32. It will also be recalled that the lower edge of groove 30 forms a lip 37. Therefore, even when ball 46 is retracted into cavities 58 and the short leg 18 is retracted out of short leg bore 22 so that the padlock is open, nevertheless the engagement of ball 46 with inner flat 32 and lip 37 prevents long leg 16 from being retracted out of long leg bore 20.

The circumferential shape of groove 30 allows long leg 16 to rotate within long leg bore 20 (i.e. shackle 14 can be rotated about long leg 16) when the padlock is open. Groove 30 effectively creates track within which ball 46 can roll as shackle 14 rotates.

The locked and unlocked positions of the camming member 44 and locking balls 46 and 48 is illustrated in more detail in FIGS. 3 to 5A.

The actuator 41 provided in the body 12 of the keyless padlock 10 is energised as required by the battery 40 provided in the body 12 and controlled by the printed circuit board 42. As illustrated, the actuator 41 is typically approximately centrally located within the body 12 of the keyless padlock 10 in a position similar to that held by the key cylinder in a conventional padlock.

In the preferred embodiment, a switch 50 is provided in the body 12 associated with the short arm 18 of the shackle 14 such that when the short arm 18 of the shackle 14 is aligned with the short arm bore 22 in the body 12 and depressed by the user in order to lock the padlock, the switch 50 is typically activated which in turn is used to signal the actuator 41 to rotate the camming member 44 to lock the shackle 14.

The software application operating on the personal computing device will typically access a unique identifying code which is particular to the keyless padlock and, as desired, transmit that unique identifying code to be keyless padlock. Once the keyless padlock receives the unique identifying code via the receiver, the at least one control assembly will typically trigger the at least one actuator to lock or unlock the padlock is the unique identifying code received matches that required by the keyless padlock and the keyless padlock will not be locked or unlocked if the unique identifying code does not match.

The provision of a unique identifying code means that the keyless padlock does not require a physical key, nor preferably as the provision in the keyless padlock for insertion of a physical key in order to open the padlock.

Figure 6:
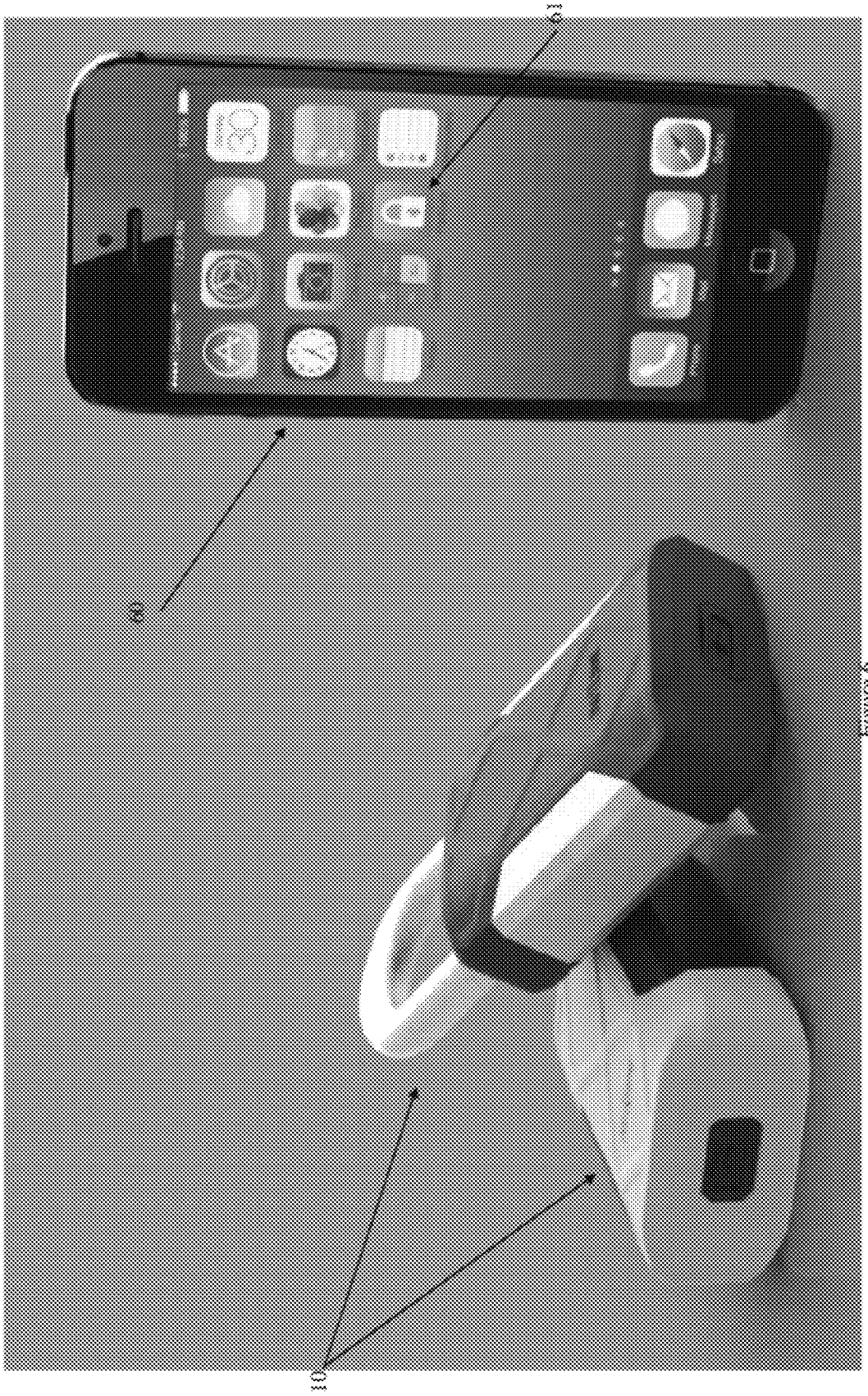
FIG. 6 is a schematic view of the keyless padlock and smartphone operating the software application according to a preferred embodiment of the system of the present invention.

The system of the present invention preferably includes two component parts, namely the keyless padlock and software application which is operable on a personal computing device such as a smartphone 60 as illustrated in FIG. 6 which is carried by a person and is therefore easily accessible to the user at the majority of times. Smartphones include a processor having an associated memory for storing instructions and a display upon which an interface can be generated and displayed allowing user interaction with the software application. As mentioned above, smartphones also have access to a number of communications pathways such that the unique identifying code can be transmitted via any one or more of a variety of communications pathways. These communications pathways typically include Wi-Fi, Bluetooth as well as telecommunications networks and data links. According to the most preferred embodiment, the keyless padlock 10 will operate via Bluetooth connection with the smartphone.

Normally the software application operates according to instructions stored in the memory of the smartphone 60 and put into effect using the processor and controlled by interaction with the user via the interface generated and displayed on the display and/or other input apparatus provided with the personal computer device in order to retrieve and transmit the unique identifying code to the padlock 10 as required. In the simplest form, the unique identifying code is stored on the smartphone 60 (typically in the memory associated with the software application) which has been paired with the keyless padlock 10.

The preferred embodiment of the software application is preferably relatively simple. The first time the software application is initialised by tapping the application icon 61 on the display of the smartphone 60 (or alternatively at any time there after), the software application then establishes the communications pathways using the smartphone upon which it is operating to search for devices which can be paired with the smartphone. This will typically identify the keyless padlock 10 as a device which can be paired. Pairing the keyless padlock 10 with the smartphone 60 then allows the unique identifying code for the keyless padlock 10 to be stored in the memory of the smartphone 60. The pairing process may also provide information in relation to the user and/or the smartphone 60 of the user, to the keyless padlock. Thereafter, as required, the authorised user will typically use the paired smartphone 60 to send unique identifying code to the padlock 10 in order to operate the padlock 10. If the unique identifying code is a match to that of the keyless padlock, then the padlock can be operated and if not, the lock can be operated.

Figure 7:
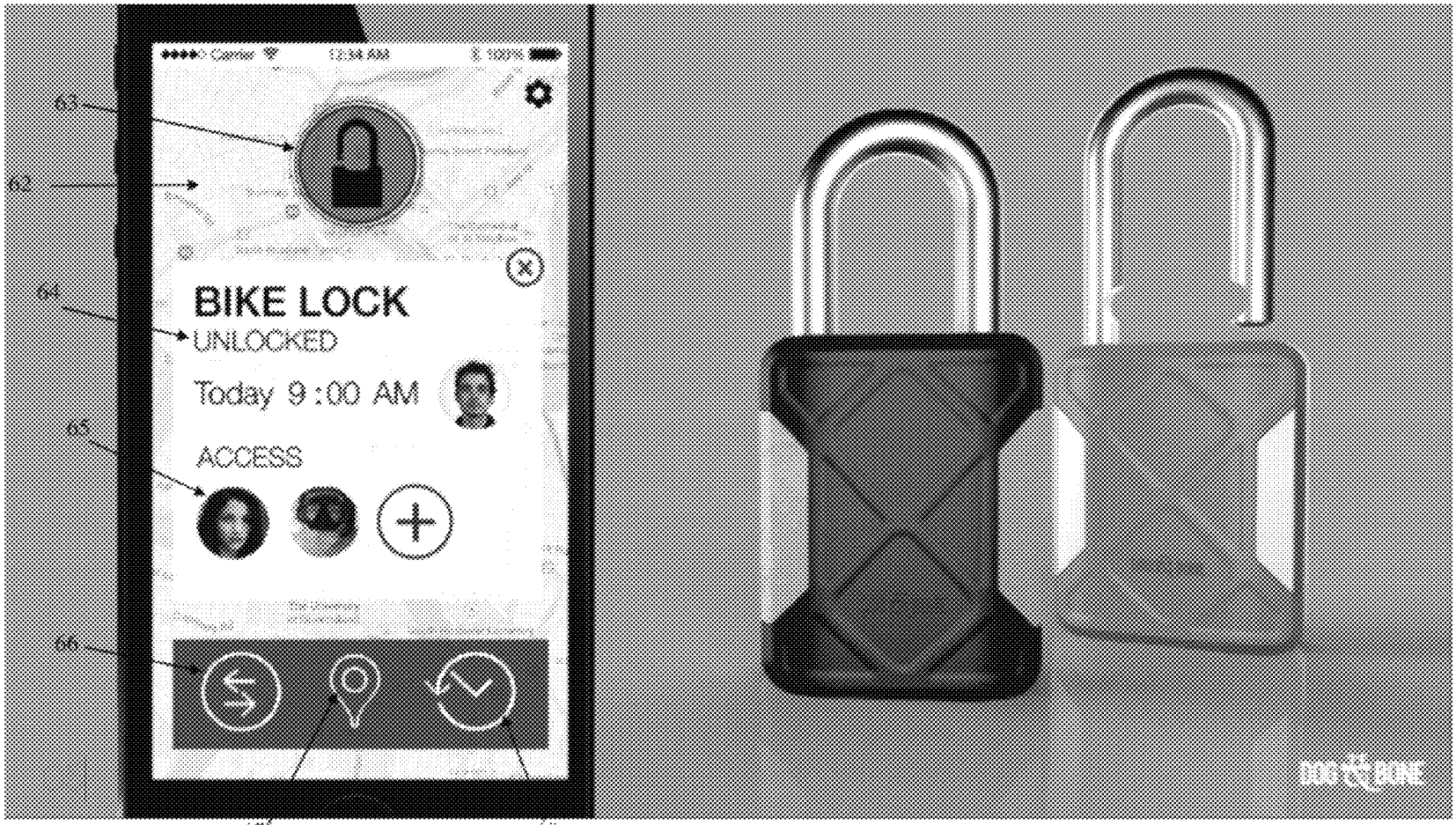
FIG. 7 is a more detailed view of an interface generated on the smartphone of an owner by the software application according to a preferred embodiment of the present invention.

As illustrated in FIG. 7 in particular, the software application of the preferred embodiment provides an interface that allows the location of the keyless padlock which has been paired with the particular smartphone 60 to be determined geographically in the form of a map 61. The interface may provide other information including status of the padlock and the embodiment illustrated in FIG. 7 does so graphically via icon 63 and also in text 64.

Due the complexity of the smartphones 60 which would typically be used according to the present invention, many of these will have access to positioning systems such as GPS. Typically, the software application, upon the padlock being locked, will typically note the position of the smartphone 60 (which will typically be relatively close to the keyless padlock 10) using the positioning system of the smartphone 60 and store this in the memory of the smartphone 60 or the software application. This will allow a user to locate the keyless padlock which has been paired to the smartphone 60 if the user forgets where the padlock is located.

Figure 9:
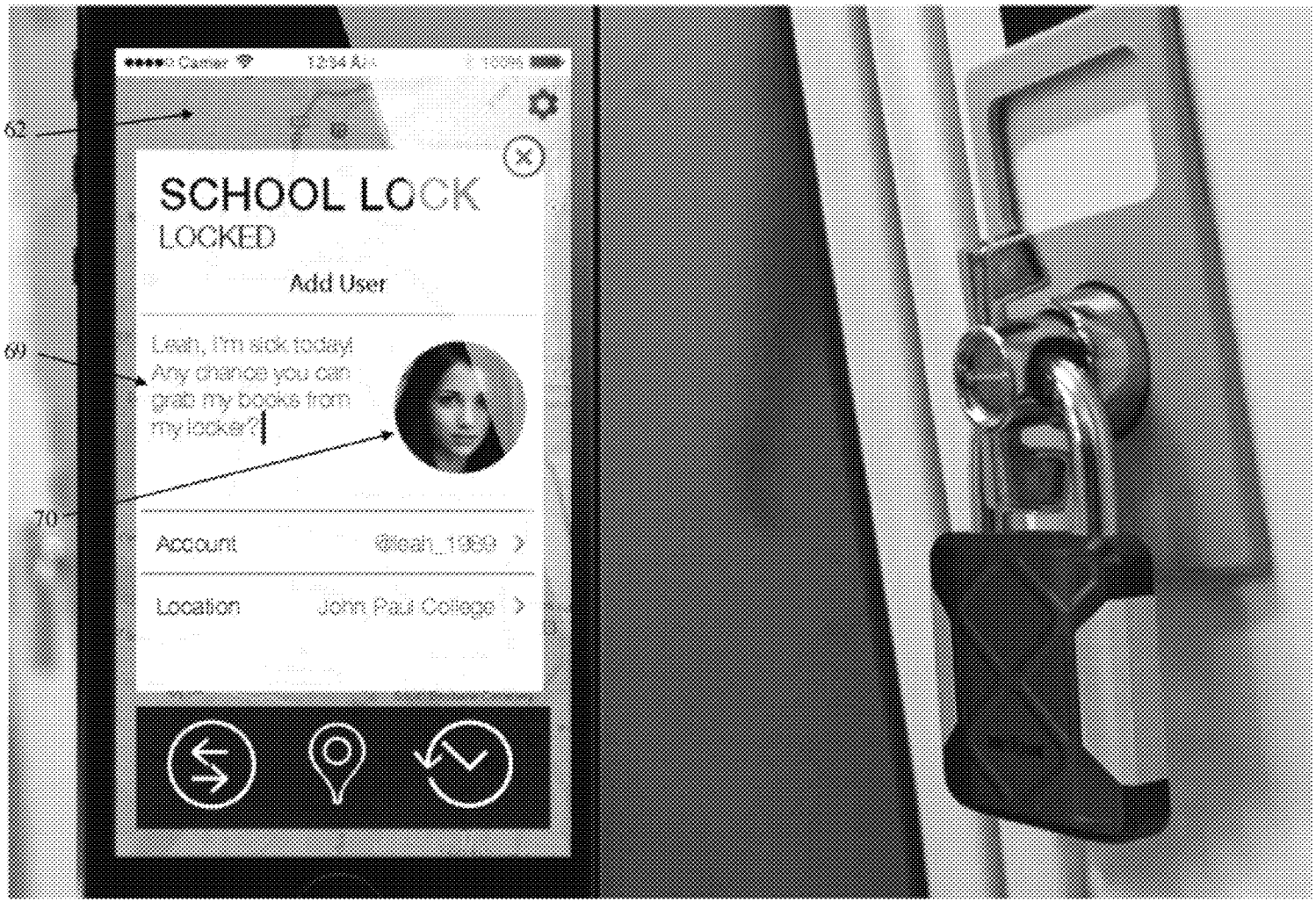
FIG. 9 is a schematic illustration of an interface generated on the smartphone of a third party by the software application upon receipt of authorisation to unlock a keyless padlock belonging to an owner.

This information can be forwarded to a third party if the authorised user request that third-party operate the lock as illustrated in FIG. 9. Typically, this information will be capable of display on the interface of the third party's smartphone 60 as seen in FIG. 9.

The software application can also preferably be used to authorise third parties to operate the keyless padlock. This authorisation may be provided to a third party by an authorised user permanently until revoked or alternatively, as outlined above, authorisation may be given on a single use basis. Normally, the owner of the padlock can authorise third parties using the software application on their smartphone 60 in association with the contacts list of the smartphone 60. The interface on the smartphone 60 of the owner may therefore also include identification, typically photos 65 of the third parties that can be authorised to unlock the padlock on the owner's behalf as illustrated in FIG. 7.

The interface includes an action (lock/unlock) icon 66, and a pin icon 67 to save the location of the padlock in the memory of the smartphone 60. There is also an icon 68 provided to authorise third parties.

In circumstances in which the owner wants to authorise a third party to operate the padlock, the unique identifying code will normally be provided to the third-party by the owner. According to the preferred embodiment, the owner is able to authorise third parties using their smartphone 60 which then allows the owner to transmit a message to third parties as and when the owner wishes, to authorise the third party to operate the keyless padlock. Once an owner has chosen a third party to authorise, normally from the contacts list stored on the smartphone 60 or using the identifiers on the interface illustrated in FIG. 7, the software application transmits an information package or signal to the smartphone 60 of the third-party which the third-party can then use to provide the unique identifying code to the keyless padlock Importantly, this system may operate such that the third-party does not ever have knowledge of the particular unique identifying code but the unique identifying code is simply provided from the authorised user's smartphone 60 to the third-party's smartphone 60 and once transmitted to the keyless padlock 10, is preferably erased or deleted from the third parties smartphone 60 or otherwise rendered inactive.

Figure 8:
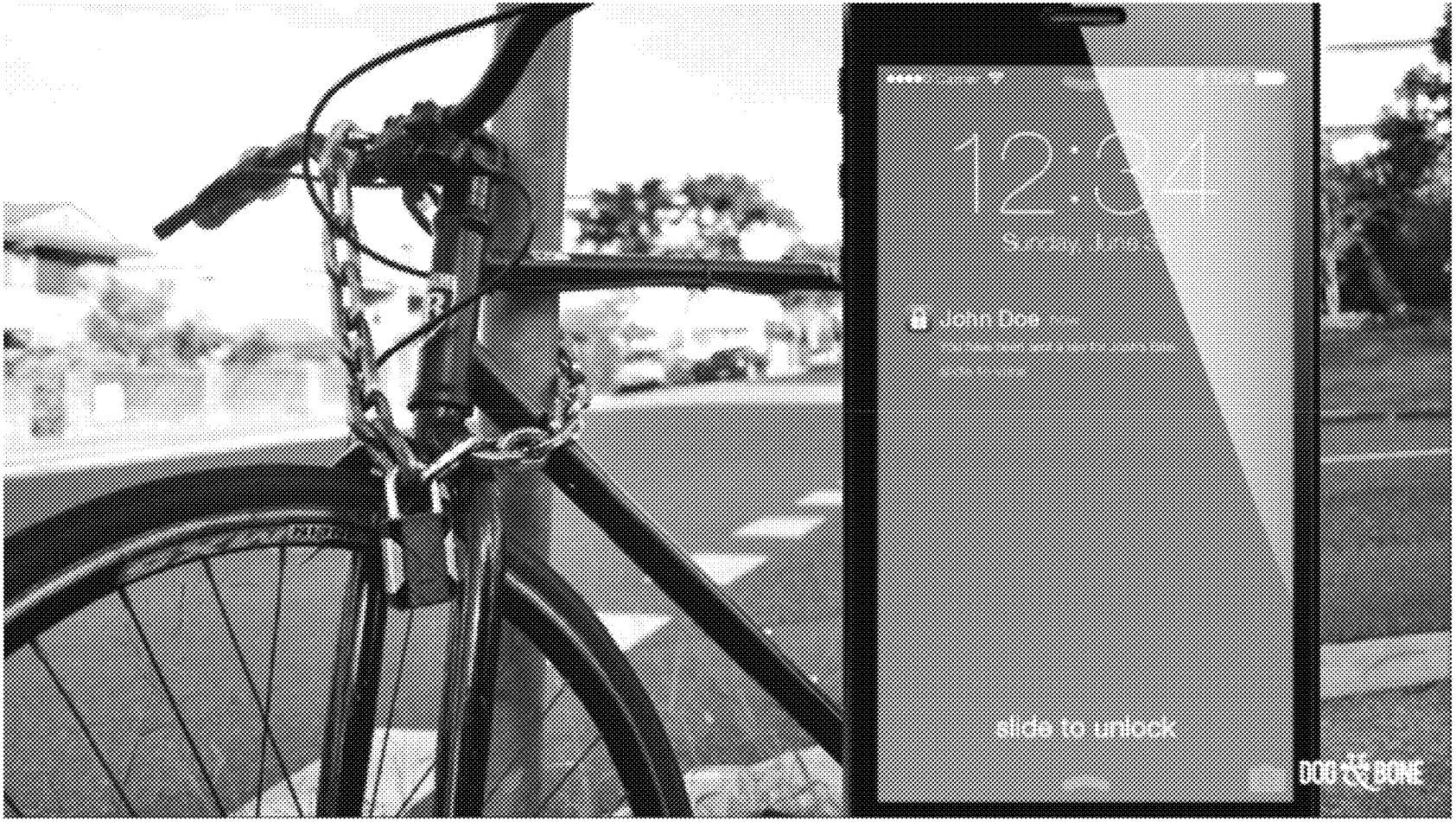
FIG. 8 is a schematic illustration of a message interface generated on the smartphone of a third party by the software application upon receipt of authorisation to unlock a keyless padlock belonging to an owner.

A message such as that displayed in FIG. 8 is normally delivered requesting the third party's assistance. The third party would then access their smartphone 60 and the software application would normally display an interface such as that illustrated in FIG. 9. This interface is similar to the interface illustrated in FIG. 7 in that it indicates the status of the padlock 10 for which they have been granted authorisation to operate and also provides a map 62 showing the geographic location of the padlock 10 as well as a location in text. The interface also includes a message 69 requesting assistance and indicating that the unique identifying code of the particular padlock 10 has been provided. A photo 70 of the owner of the padlock is also included as well as their account details.

The third-party can then use the provided unique identifying code on behalf of the owner to operate the padlock is required.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A keyless padlock system including a. a keyless padlock having a padlock body, a shackle, a locking mechanism located in the body and associated with the shackle to lock the shackle to the body in a locked condition and to release at least a part of the shackle in an unlocked condition, at least one receiver, at least one control assembly and at least one actuator; and b. a personal computing device having at least one transmitter, a processor with memory operating a software application and a display, the software application accessing a identifying code unique to the keyless padlock and transmitting said identifying code to the padlock, wherein the at least one control assembly of the padlock will trigger the at least one actuator to unlock the padlock shackle if the identifying code received by the at least one receiver of the padlock matches that of the padlock and will not open if the identifying code does not match.

2. A keyless padlock system as claimed in claim 1 wherein the unique identifying code is a code or signal which is matched to the keyless padlock.

3. A keyless padlock system as claimed in claim 1 wherein the unique identifying code and the keyless padlock form a matched pair with the unique identifying code being provided to the keyless padlock each time the padlock is required to be operated.

4. A keyless padlock system as claimed in claim 1 wherein the unique identifying code is generated substantially in real time each time the operation of the keyless padlock is prompted and communicated to both the keyless padlock and to the personal computing device for transmission to the keyless padlock.

5. A keyless padlock system as claimed in claim 1 wherein the keyless padlock utilises a multifactor authentication protocol.

6. A keyless padlock system as claimed in claim 4 wherein the keyless padlock includes a transmitter in order to request additional information either from the user, from a third-party or from an external system administrator implementing a multifactor authentication protocol.

7. A keyless padlock system as claimed in claim 1 wherein provision of the unique identifying code to the padlock is undertaken by any personal computing device.

8. A keyless padlock system as claimed in claim 1 wherein the unique identifying code is required to be provided from a specific personal computer device with the unique identifying code including one or more details which are unique to the personal computer device transmitting the code.

9. A keyless padlock system as claimed in claim 8 wherein the one or more details unique to the personal computing device are obtained directly from the personal computing device each time the transmission is made rather than being stored in the software application.

10. A keyless padlock system as claimed in claim 1 wherein access is provided to the software application by download to a user's personal computing device and once the software application has been downloaded, the personal computing device can then be paired with the keyless padlock.

11. A keyless padlock system as claimed in claim 1 wherein the unique identifying code is provided by a third party on behalf of an authorised user in order to allow the third-party to operate the keyless padlock with the unique identifying code be provided to the third-party by the authorised user or with the authorised user's consent from a system administrator, the third party also having a personal computing device operating the software application.

12. A keyless padlock system as claimed in claim 1 wherein the software application operates according to instructions stored in the memory of the personal computing device and put into effect using the processor and controlled by interaction with the user via an interface generated and displayed on the display and other input apparatus provided with the personal computer device in order to retrieve and transmit the unique identifying code to the padlock as required.

13. A keyless padlock system as claimed in claim 1 wherein the software application provides an interface that allows a location of the keyless padlock which has been paired with the personal computing device to be determined geographically.

14. A keyless padlock system as claimed in claim 1 wherein the software application, upon the padlock being locked, notes a geographic position of the personal computing device using a positioning system of the personal computing device and stores this geographic position in the memory of the personal computing device.

15. A keyless padlock system as claimed in claim 11 wherein authorisation is provided to a third party by an authorised user on a single use basis.

16. A keyless padlock system as claimed in claim 11 wherein once the authorised third-party has operated the keyless padlock, the software application operating on the third party's personal computer device provides feedback to the authorised user's personal computing device allowing the authorised user to ascertain the identity of the third-party operating the keyless padlock in confirmation.

* * * * *